US006163985A

United States Patent [19]

Chinnery et al.

[11] Patent Number: 6,163,985

[45] Date of Patent: Dec. 26, 2000

[54] SYSTEM FOR CONTROLLING A SNOWPLOW AND OTHER VEHICLE ACCESSORIES

[75] Inventors: Ronald Thomas Chinnery, Independence; Lynn Edon Richardson, Lee's Summit, both of Mo.

[73] Assignee: The Louis Berkman Company, Steubenville, Ohio

[21] Appl. No.: 09/285,978

[22] Filed: Apr. 5, 1999

[51] Int. Cl.[7] ..... E01H 5/04

[52] U.S. Cl. ..... 37/234; 37/236

[58] Field of Search ..... 37/231, 232, 234, 37/235, 236, 266, 348, 382; 172/2, 3, 4, 4.5, 7, 8; 701/50

[56] References Cited

U.S. PATENT DOCUMENTS

| | | | |
|---|---|---|---|
| 3,706,144 | 12/1972 | Miceli . | |
| 4,831,752 | 5/1989 | Clevenger | 37/234 |
| 4,999,935 | 3/1991 | Simi et al. | 37/236 |
| 5,265,356 | 11/1993 | Winter | 37/234 |
| 5,361,519 | 11/1994 | Ciula et al. . | |
| 5,462,125 | 10/1995 | Stratton et al. | 172/826 |
| 5,503,232 | 4/1996 | Matsushita et al. | 172/2 |
| 5,524,368 | 6/1996 | Struck et al. . | |
| 5,815,956 | 10/1998 | Lavin et al. | 37/241 |
| 5,832,637 | 11/1998 | Aguado et al. | 37/234 |
| 6,044,579 | 4/2000 | Hadler et al. | 37/234 |

*Primary Examiner*—Victor Batson
*Attorney, Agent, or Firm*—Vickers, Daniels & Young

[57] ABSTRACT

A system is provided for controlling the positions of a vehicle snow plow hydraulic lift control cylinder for raising the plow upon activation of a first solenoid by a first control signal, and at least one hydraulic pivot cylinder for pivoting said plow with respect to the vehicle upon activation of a second solenoid by a second control signal, where the vehicle has an electrical network. The system comprises a manual switching unit including a first switch for creating a first digital command signal, a second switch for creating a second digital command signal, a coding circuit for creating a first communication signal upon receipt of the first digital command signal and a second communication signal upon receipt of the second digital command signal, a connector adapted to be manually received in an existing receptacle chamber in the vehicle, wherein the receptacle chamber has at least one connector terminal connected to the electrical network, and the connector includes an electrical element adapted to be electrically connected to the terminal for applying said communication signals to the electrical network, and a solenoid operating unit fixed on the vehicle with an input connected to the network, outputs connected to each of the solenoids, and a receiver circuit for creating the first command signal upon receipt of the first communication signal and the second command signal upon receipt of the second communication signal and applying the command signals to the outputs.

40 Claims, 8 Drawing Sheets

SYSTEM FOR CONTROLLING A SNOWPLOW AND OTHER VEHICLE ACCESSORIES

BACKGROUND OF THE INVENTION

The present invention relates to the art of automotive vehicle snowplows and accessories and controls therefor, and more particularly to a manual switching unit adapted to provide a digital control signal to the vehicle DC power bus in the passenger compartment and an operating unit in the engine compartment adapted to control a snowplow or other vehicle accessory according to the digital signal.

The invention finds particular utility in connection with a snowplow and control system of the type disclosed in U.S. Pat. Nos. 3,706,144 to Miceli and U.S. Pat. No. 5,361,519 to Ciula, et al., owned by the assignee of the present invention and the disclosures of which are hereby incorporated herein by reference. Accordingly, the invention will be disclosed and described in detail herein in conjunction with a plow and control system according to the Miceli and Ciula patents. It will be appreciated, however, that the present invention can be applied to other accessories and control system configurations.

In a snowplow and control system arrangement of the type disclosed in the Miceli patent, the snowplow blade is mounted on the front of a vehicle along with hydraulic cylinders by which the blade is raised and lowered with respect to the vehicle and by which the blade is angled or pivoted left or right relative to the vehicle. The plow control system further includes solenoid operated valves by which the flow of hydraulic fluid to and from the cylinders is controlled. Positioning of the plow blade through control of the solenoid valves and an electric motor driven hydraulic pump in the system is achieved through a control device mounted in the vehicle passenger compartment for operation by the vehicle operator. Additional controls are optionally provided for auxiliary lighting such as those shown in U.S. Pat. No. 5,832,637 to Aguado et al., the disclosure of which is incorporated herein by reference.

In the systems of the Miceli and Ciula patents, a multiple conductor cable harness extends from the vehicle passenger compartment to the engine compartment. A control device is mounted in the passenger compartment and provides electrical control signals through the cable harness to the solenoids and the electric motor, thereby achieving controlled positioning of the snowplow blade. In the Miceli patent, the control device includes a pair of pivotal operating switch levers having a neutral or hold position. The first lever is pivotal from its hold position to selectively raise or lower the blade and the second lever is pivotal from its hold position to selectively angle the snowplow blade left or right. In the Ciula patent, the control device includes individual momentary type electrical switchpad buttons for selectively operating the snowplow blade in the up, down, left, and right directions, which buttons are respectively labeled U, D, L, and R. In the Miceli patent, as well as many prior art systems, the control device is mounted in a single permanent location in the vehicle passenger compartment, whereas in the Ciula patent, the control device is relocatable inside the passenger compartment for operator comfort and ergonomic efficiency.

Heretofore, the cable harness connecting the passenger compartment control device with the engine compartment or external control solenoids and motor has been difficult and costly to install, requiring the installer to make a feed-through hole in the vehicle firewall. In addition, the routing length and path as well as the firewall hole location is different for different vehicles, thus requiring suppliers of such control systems to inventory numerous different cable harnesses and associated accessories. Furthermore, installation personnel heretofore were required to be knowledgeable in the specifics of the installation procedures for many different vehicle types. Moreover, maintaining and trouble-shooting such a snowplow control system requires detailed knowledge as well as routing and wiring schematics for the specific vehicle type. The foregoing problems are compounded in the common situation where the snowplow equipment is seasonally removed for storage during warm weather, and subsequently reinstalled onto the vehicle.

Other attempts have been made to address the above problems. In U.S. Pat. No. 5,524,368 to Struck et al., a wireless snowplow control system is disclosed, which uses a wireless radio remote control to control a vehicle-mounted snowplow. The Struck system, however, introduces additional safety problems associated with a wireless receiver picking up spurious noise, potentially creating risk of unintended personal or property injury. An additional problem associated with wireless systems, particularly apparent in garage door opener applications, is the need to provide user-settable transmitter and receiver addresses, to prevent unauthorized or unintended operation by the owner of an unrelated transmitter.

SUMMARY OF THE INVENTION

In accordance with the present invention, there is provided a control system by which the foregoing and other problems and disadvantages are minimized or overcome. More particularly, and in accordance with the principal aspect of the present invention, there is provided a control system for operating a snowplow or other vehicle accessory installed on a vehicle including an operator switching unit and an operating unit, each unit being connected to the existing vehicle power network, wherein the switching unit transmits control commands to the operating unit over the existing power network. In this regard, there is no need for a cable harness or holes through the vehicle firewall since the units communicate through the preexisting electrical wiring. Thus, only minimal modifications need be made to vehicles having existing DC electric power outlets, such as those for cigarette lighters, in the passenger compartment. Installation of the equipment in the vehicle passenger compartment is as simple as connecting a plug into a standard vehicle cigarette lighter power outlet. By this arrangement, the expense in terms of time and cost of installing accessories such as snowplows onto the vehicle are virtually eliminated with regard to the passenger compartment, and greatly reduced in the vehicle exterior and engine compartment areas. Furthermore, the system is easily installed onto any type of vehicle, thus reducing inventory and installer training costs. The system provided, moreover, is easily maintained and removed from the vehicle.

In accordance with another aspect of the invention, the switching unit provides a modulated AC control signal to the existing vehicle DC electric power network, which is demodulated by the solenoid operating unit. This reduces the likelihood of unintended operation caused by spurious noise in the DC power network because the operating unit only responds to signals modulated at a certain frequency or frequencies, and which signals contain valid control data.

In accordance with yet another aspect of the invention, there is provided an operator manual switching unit for transmitting plow control commands to a solenoid operating unit through the vehicle DC power network. In this respect, a removable switching unit apparatus allows control of a vehicle plow blade where the vehicle is equipped with a solenoid operating unit or a unit for operating other accessories responsive to digital command signals applied to the vehicle DC bus. Maintenance and repair personnel can thus easily troubleshoot the control system by installing a known good switching unit into the passenger compartment to functionally test the rest of the system. In addition, this allows easy upgrade of a manual switching unit having additional switches, etc., when new accessories are added to the vehicle for operator control from the passenger compartment.

In accordance with still another aspect of the present invention, there is provided an improved method of controlling the position of a vehicle snow plow or operating other vehicle accessories, including transmitting command signals from a switching unit in the passenger compartment to a solenoid or accessory operating unit through the preexisting vehicle power network and operating the snowplow or accessory in accordance with the command signals.

In accordance with still yet another aspect of the invention, the control system further includes light controls for selective operation of headlights, turn signal lights, and the like, which lights are mounted on the snowplow frame.

In accordance with yet another aspect of the present invention, the control system includes controls for operation of vehicle mounted accessories including plows, brooms, lights, spreaders for salt or other materials, pumps, and the like.

It is accordingly a primary object of the present invention to provide an improved snowplow position control system by which a vehicle operator can position a snowplow blade with respect to the vehicle.

Another object of the present invention is the provision of a snowplow position control system of the character described above which requires no cable harness installation between the vehicle passenger and engine compartments.

Still another object of the present invention is the provision of a snowplow position control system of the character described above which reduces the cost and time required to install the system onto the vehicle and to seasonally remove the system from and reinstall it onto the vehicle.

Yet another object of the present invention is the provision of a snowplow position control system of the character described above which reduces the level of skill required of personnel installing the system onto a vehicle.

Still another object of the present invention is the provision of a snowplow position control system of the character described above which can be installed into many different types, makes, and models of vehicles with little or no modification, thus reducing inventory costs for sellers of such systems.

A further object of the present invention is the provision of a snowplow position control system of the character described above which minimizes the cost and time required to maintain and troubleshoot such systems.

Yet a further object of the present invention is the provision of a control system for vehicle mounted accessories which utilizes existing electrical vehicle wiring to communicate operator command signals from an operator in the passenger compartment to accessory operating units located proximate the accessories.

BRIEF DESCRIPTION OF THE DRAWINGS

The foregoing and other objects and advantages will become apparent from the following description of a preferred embodiment of the present invention illustrated in the accompanying drawings which form a part thereof and in which.

DESCRIPTION OF A PREFERRED EMBODIMENT

Figure 1:
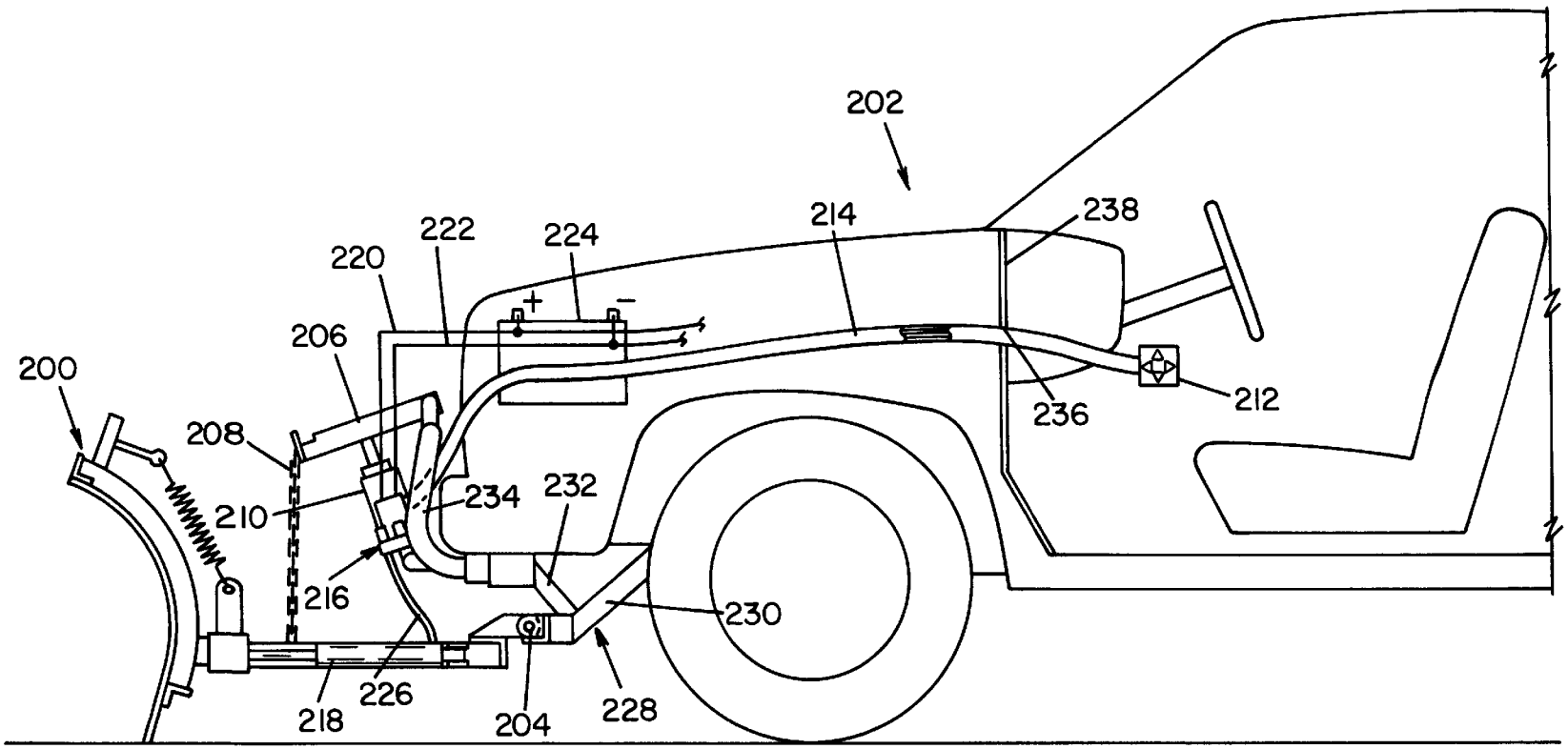
FIG. 1 PRIOR ART
FIG. 1 is a side elevation view of a prior art snowplow position control system.

Referring now to the drawings wherein the showings are for the purpose of illustrating a preferred embodiment of the present invention only, and not for the purpose of limiting the same, FIG. 1 illustrates a prior control system according to the aforementioned Miceli and Ciula patents, wherein a plow 200 is mounted on vehicle 202 for controlled vertical pivoting about axis 204 using lift arm 206 and chain 208 and wherein lift arm 206 is operated by lift cylinder 210 whereby plow 200 can be selectively raised or lowered through operator commands using control device 212 in the vehicle passenger compartment. Command signals from device 212 are transmitted through cable harness 214 to hydraulic control unit 216 which includes a hydraulic reservoir and pump (not shown) for actuating cylinder 210. In similar fashion, plow 200 is pivotal horizontally about a vertical axis (not shown) using pivot cylinder 218, which pivoting is controlled by hydraulic control unit 216 in response to control signals from control device 212. Hydraulic control unit 216 derives electrical power through lines 220 and 222 from vehicle battery 224 and provides a controlled supply of hydraulic fluid to cylinder 218 through line 226 as more fully described in the Miceli and Ciula patents. Plow 200 is mounted onto the frame (not shown) of vehicle 202 by a plow frame 228 having mounting brackets 230 and 232 and a vertical bracket 234 upon which hydraulic control unit 216 is mounted. Cable harness 214 is routed from hydraulic control unit 216 though the engine compartment of vehicle 202 and a hole 236 in firewall 238 into the passenger compartment of vehicle 202, thereby connecting control unit 216 with control device 212. Control device 212 may be removably located in various locations inside the passenger compartment of vehicle 202, as illustrated in the Ciula patent. Prior to installation of the system shown in FIG. 1, hole 236 in firewall 238 must be drilled. In addition, the length of cable harness 214 must be sized according to specific dimensions of the engine and passenger compartments of the specific vehicle.

Figure 2:
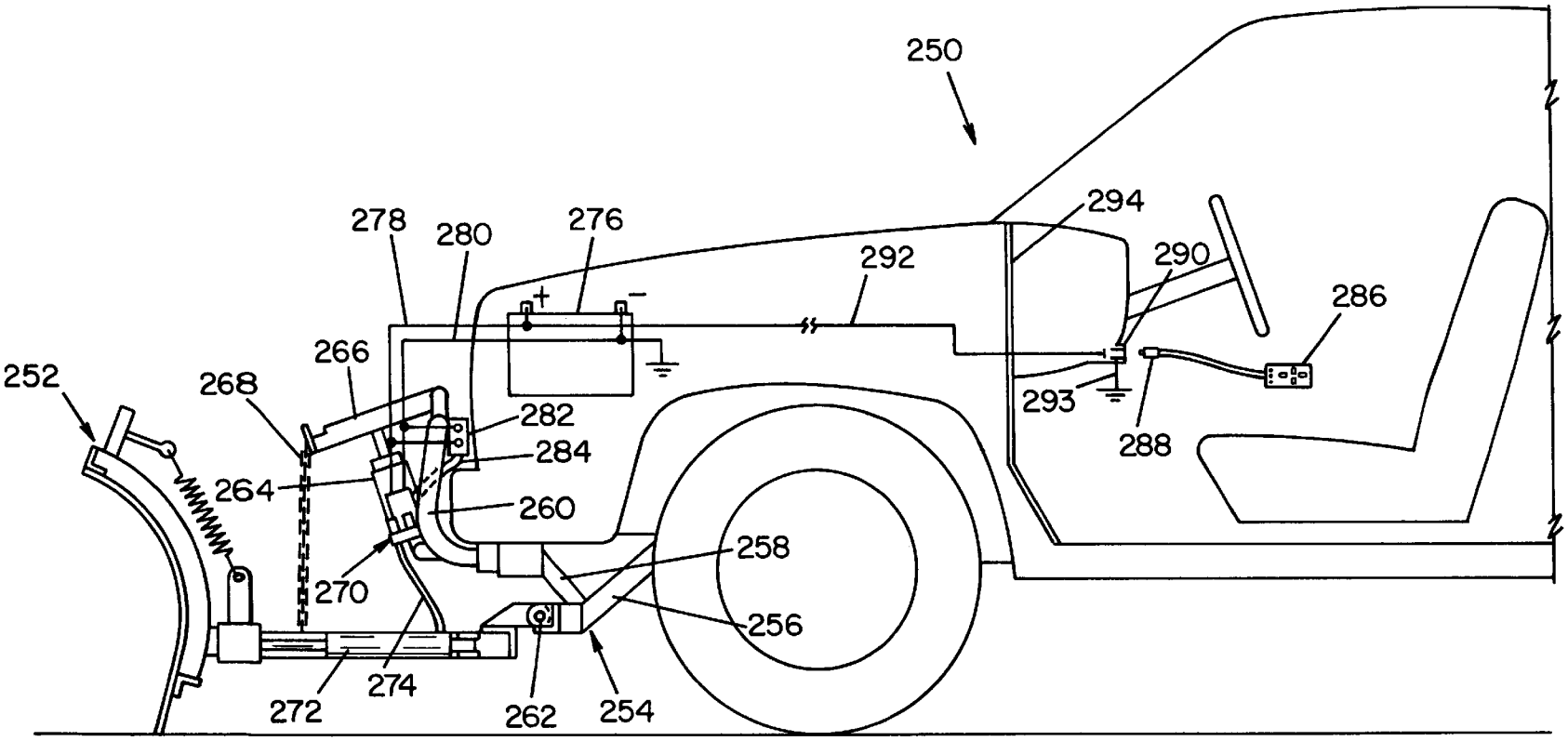
FIG. 2 is a side elevation view of a snowplow position control system in accordance with the present invention.

FIG. 2 illustrates a vehicle 250 including a control system according to the present invention for controlling the position of plow 252. Plow 252 is mounted on vehicle 250 by a plow frame 254 which includes mounting brackets 256 and 258, and a vertical bracket 260. Plow 252 is mounted on the plow frame for pivotal movement about a horizontal axis 262, and the vertical position of plow 252 is controlled by lift cylinder 264 which is mounted on bracket 260. More particularly, a lift arm 266 and chain 268 are actuated in response to hydraulic fluid supplied to cylinder 264 from hydraulic control unit 270 to control the vertical position of plow 252. Plow 252 is also pivotal horizontally about a vertical axis (not shown) using pivot cylinder 272 which is actuated in response to hydraulic fluid supplied thereto by hydraulic control unit 270 through line 274. Control unit 270 derives electrical power from the vehicle battery 276 through power lines 278 and 280, respectively connected to the positive and negative terminals of battery 276. Unlike the snowplow control systems of the prior art, including that shown in FIG. 1, and as will be described in detail hereinafter, control unit 270 operates in response to control signals from a solenoid operating unit 282 through cable 284. Solenoid operating unit 282 derives power from the battery 276 through lines 278, 280 and, as will become apparent hereinafter receives control signals transmitted from a manual switching unit 286 in response to actuation of switches on the manual switching unit by the operator in the passenger compartment of vehicle 250. Switching unit 286 includes a power cable connector 288 adapted to connect with a standard vehicle cigarette lighter power outlet 290 which includes a terminal connected to the positive terminal of vehicle battery 276 through line 292, as well as a terminal grounded by connection to the vehicle chassis. Although switching unit 286 is shown in FIG. 2 disconnected from outlet 290, in operation unit 286 is connected to power line 292 from battery 276 by insertion of connector 288 into outlet 290. When so connected, unit 286 derives power from battery 276, and transmits control signals to solenoid operating unit 282 through positive battery connection lines 292 and 278 in response to the operator actuating the switches of switching unit 286.

Figure 3:
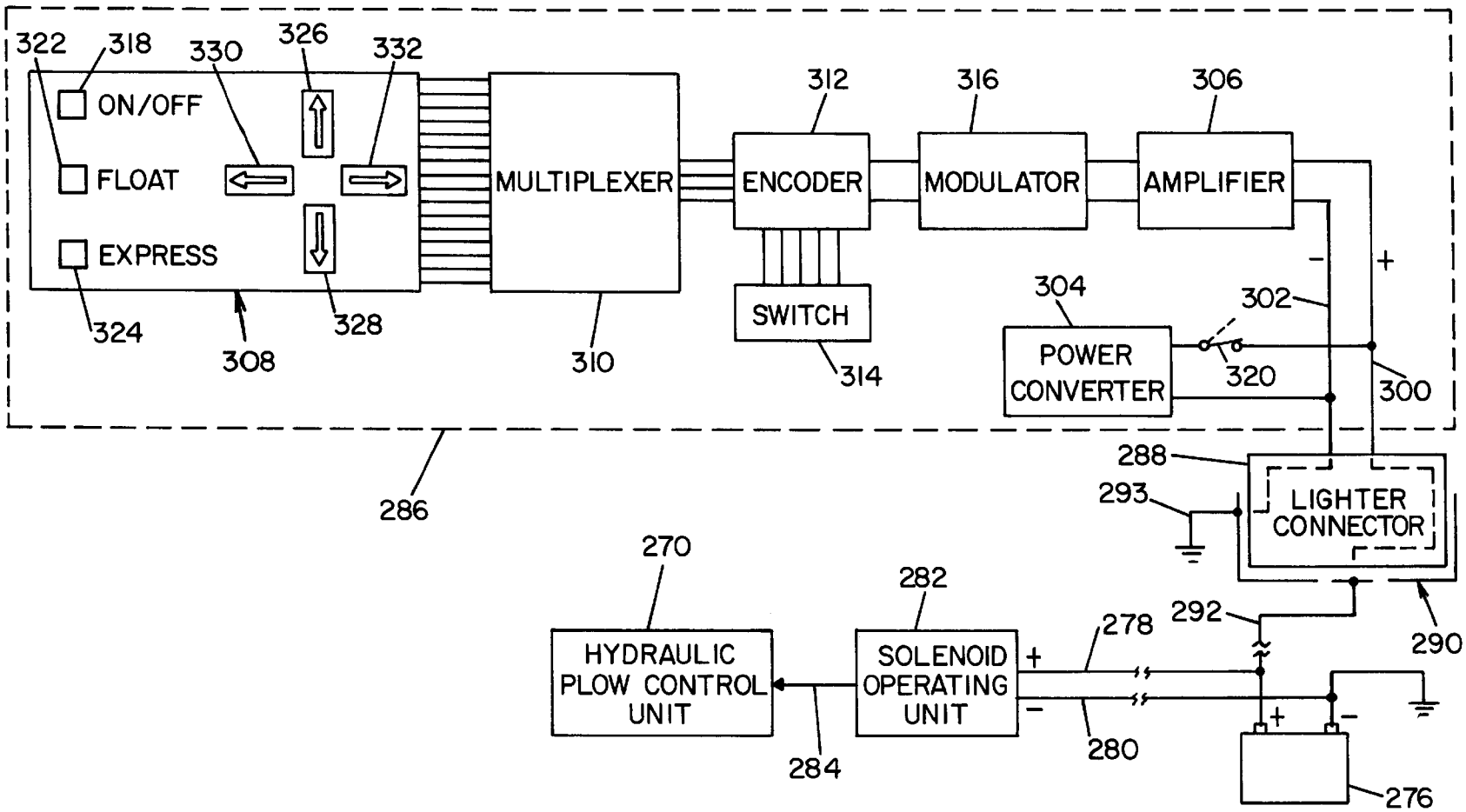
FIG. 3 is a schematic illustration of a manual switching unit in accordance with the present invention.

As illustrated in FIG. 3, manual switching unit 286 includes connector 288 providing positive and negative connections to the vehicle DC power through lines 300 and 302, respectively by installation into outlet 290, and to which are connected power converter 304 included within unit 286 and amplifier 306. When switch 320 is closed, power converter 304 converts power derived from lines 300 and 302 into electrical power at levels usable for supplying the remainder of components included within switching unit 286 which are discussed further hereinafter. Thus, unit 286 preferably derives power from the vehicle battery 276. However, it will be appreciated that unit 286 alternatively or in combination can derive power from another source including a separate battery included within unit 286. Switching unit 286 further includes switchpad 308, multiplexer 310, encoder 312, switch 314 and modulator 316, each of which is powered by power converter 304 through connections to the individual components, not shown. Switchpad 308 further includes power switch button 318 for opening and closing power switch 320, float switch 322 and express switch 324, which operate as described further hereinafter, as well as up, down, left and right switches 326, 328, 330 and 332, respectively. Switches 322 through 332 individually generate binary electrical signals representing whether the individual switch is pressed or unpressed, and the switches are connected collectively to multiplexer 310, which in turn generates a digital signal representative of the collective switch states. Encoder 312 generates a serial data stream in response to the multiplexed switch state signal of multiplexer 310 as well as the signal from switch 314 which is used to set a unique binary address for individual manual switching units. It will be appreciated that although FIG. 3 illustrates multiplexer 310 having sixteen inputs and four outputs, that multiplexers of different binary capacities such as 8×3, or 32×5, etc., are within the scope of the present invention, as are switchpads having more switches than those shown in FIG. 3 or different combinations thereof, the only limitation being that multiplexer 310 must have sufficient inputs to accommodate all switches of switchpad 308. Encoder 312 provides a serial data stream representative of the output signals from multiplexer 310 as well as the output signals from switch 314 or either of them, to modulator 316. Modulator 316 in turn provides a frequency modulated signal in response to the output signal from encoder 312, which can be an FM (frequency modulated) signal, or an FSK (frequency shift keying) signal. The modulated signal is applied to amplifier 306, which couples the modulated signal through AC or capacitive coupling onto the vehicle battery positive polarity line throughout the vehicle through connector 288. Manual switching unit 286 thereby provides a modulated signal representative of the collective states of the switches 322 through 332 of switchpad 308 to the entire 12-volt DC power network throughout the vehicle. As shown in FIG. 2, this allows receipt of the modulated signal by solenoid operating unit 282 by simple connection thereof to the vehicle's DC 12-volt power bus without the installer having to drill holes in firewall 294, and further eliminates the lengthy and bulky cable harness 214 required of prior art systems as shown in FIG. 1.

Figure 4:
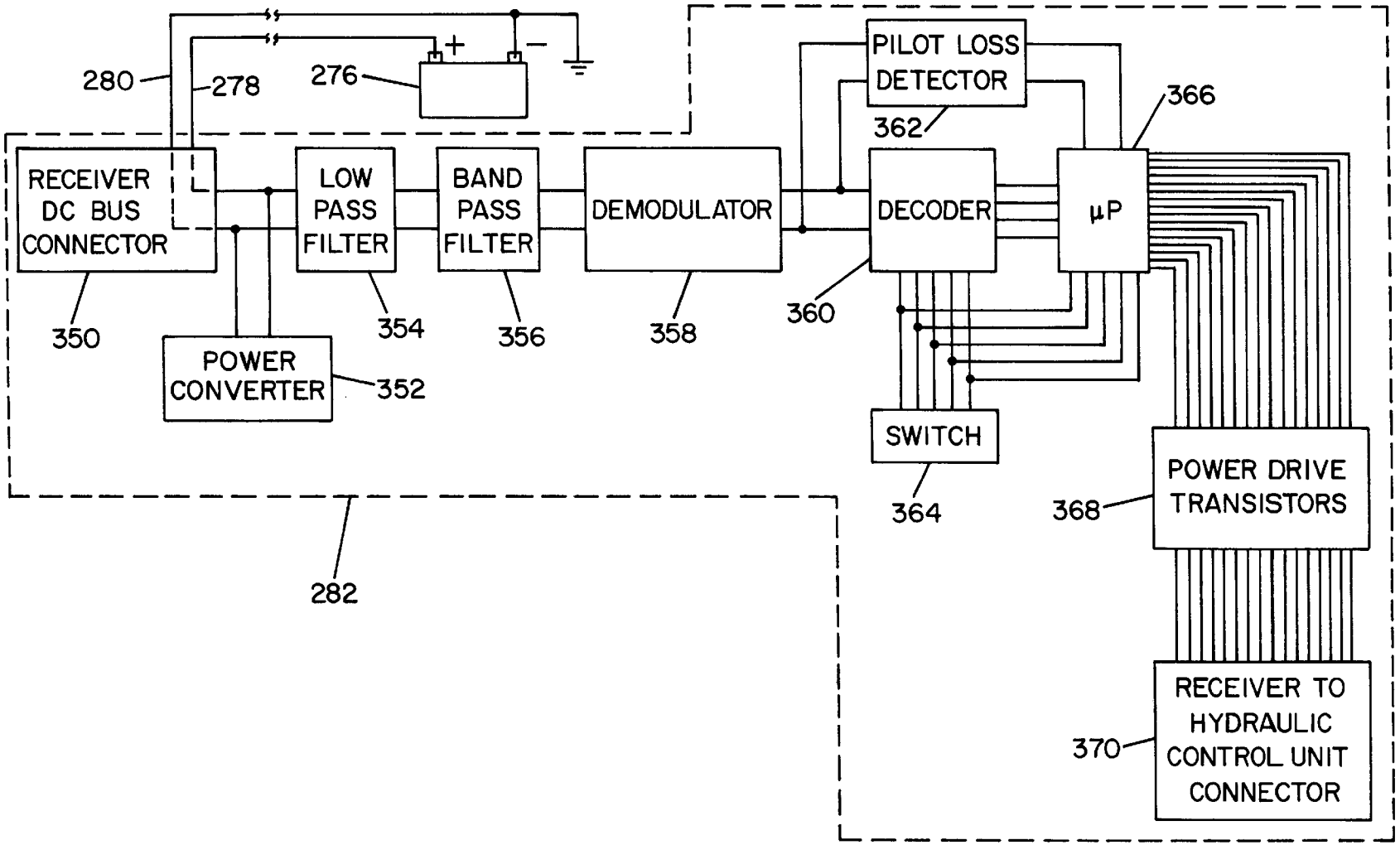
FIG. 4 is a schematic illustration of a solenoid operating unit in accordance with the present invention.

The details of solenoid operating unit 282 are discussed hereinafter with reference to FIG. 4. Unit 282 includes a receiver DC bus connector 350 for connection to the positive and negative polarity terminals of battery 276 respectively through lines 278 and 280, and a power converter 352 for converting the vehicle's DC battery power into electrical power at levels appropriate to supply the components of unit 282 which are discussed further hereinafter. Although unit 282 is illustrated and described herein as deriving power from vehicle battery 276, it will be appreciated that unit 282 can alternatively or in combination derive power from another source. Battery lines 278 and 280 are connected to low pass filter 354 through an AC coupling or capacitive coupling network (not shown), thereby supplying a pure AC modulated signal to low pass filter 354, which removes unwanted high frequency components therefrom and supplies a filtered signal to band pass filter 356. Filter 356 in turn provides an AC signal to demodulator 358 comprising only the frequency components consistent with the FM or FSK modulating scheme of manual switching unit 286 as described hereinabove. Demodulator 358 provides a demodulated digital signal in serial form to both decoder 360 and pilot loss detector 362 from which decoder 360 generates a parallel digital signal representative of the collective state of manual switching unit switches 322 through 332 as transmitted through the vehicle DC power lines 278 and 280 by manual switching unit 286. Switch 364 provides digital signals to both decoder 360 and microprocessor 366, which are used for determining whether the received signals are generated by manual switching unit 286 with corresponding switch settings, thereby preventing unauthorized operation of the control system. Decoder 360 provides a digital output signal representing, in multiplexed form, the switch states of switches 322 through 332 of switchpad 308 on the manual switching unit 286 to microprocessor 366, which in turn provides individual actuating signals to the power drive transistor unit 368, the outputs of which are individually connected to the solenoids, electric motors, plow lights, etc., included within hydraulic control unit 270 of FIG. 2, through connector 370. This provides control of the snowplow position both vertically and horizontally as well as control of auxiliary plow lights and other accessories associated therewith, by microprocessor 366 based upon the signal from decoder 360. Pilot loss detector 362 monitors the output of demodulator 358 and provides a signal to microprocessor 366 upon detecting loss of an FM or FSK signal, thus indicating malfunction in the control system. Upon detection by pilot loss detector 362 of a lost signal condition, microprocessor 366 actuates hydraulic control unit 270 in order to place the plow 252 of FIG. 2 into a failsafe position, for example, full upward position. Other failsafe conditions for plow lights, accessory lights, etc., are determined by the logic of microprocessor 366 in similar fashion.

Figure 5:
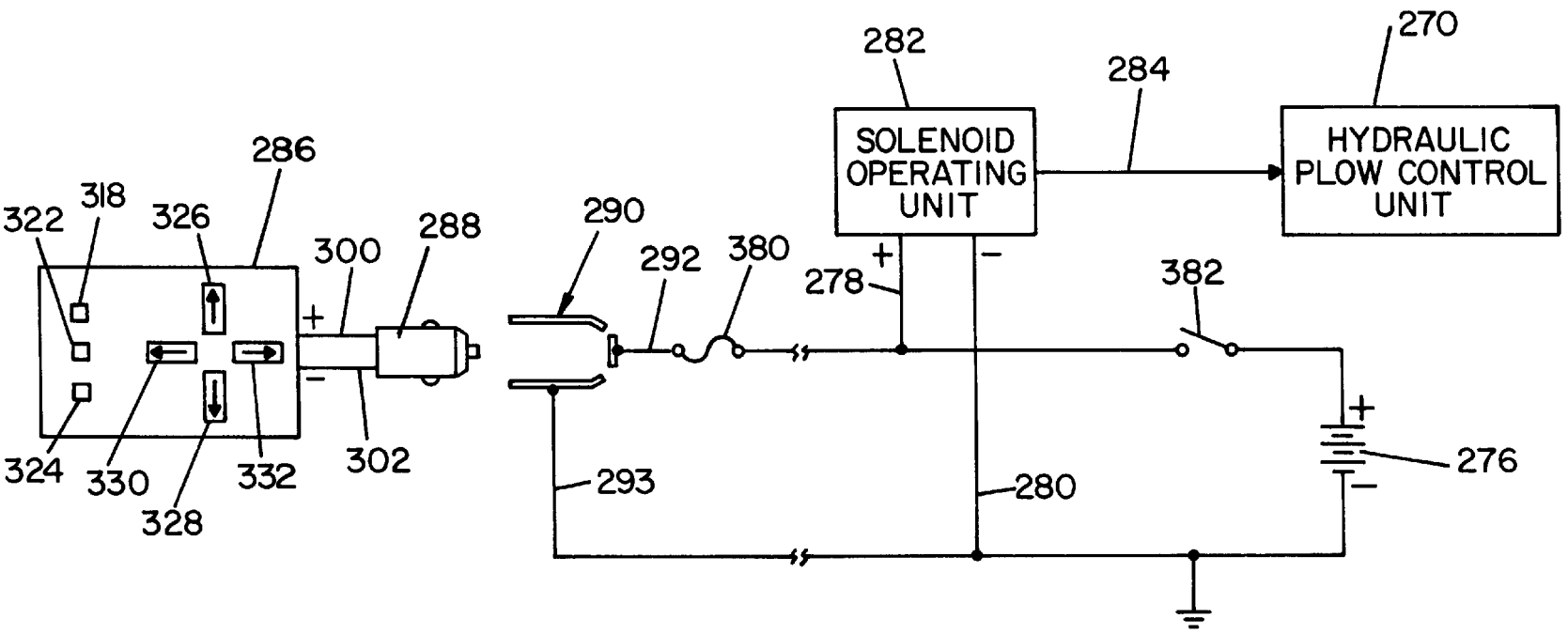
FIG. 5 is a schematic illustration of the wiring connections required for a snowplow position control system in accordance with the present invention.

As shown in FIG. 5, manual switching unit 286 is connected to the vehicle DC power bus using connector 288 which is inserted into power outlet 290 having connection 293 to the vehicle chassis ground as well as connection 292 to the positive terminal of battery 276 through fuse 380 and ignition switch 382. Solenoid operating unit 282 likewise connects to the vehicle DC power system through line 280 to ground and line 278 to the positive terminal of battery 276 through ignition switch 382. Solenoid operating unit 282 provides electrical signals for controlling the position of plow 252 to hydraulic plow control unit 270 through line 284. As will be appreciated from FIG. 5 as well as FIG. 2, initial installation of the present invention is far less intrusive than that of the prior art systems discussed above. Once connections 278 and 280 are made between the vehicle DC power system and solenoid operating unit 282, seasonal installation and removal of the system is a simple matter of removing manual switching unit 286 from the vehicle passenger compartment by disconnecting connector 288 from the passenger compartment cigarette lighter outlet, and disconnecting cable 284 from the hydraulic control unit 270 using connector 370, thereby allowing snowplow 252 and plow frame 254 along with any accessories mounted thereon to be easily removed for storage during warm weather.

Figure 6:
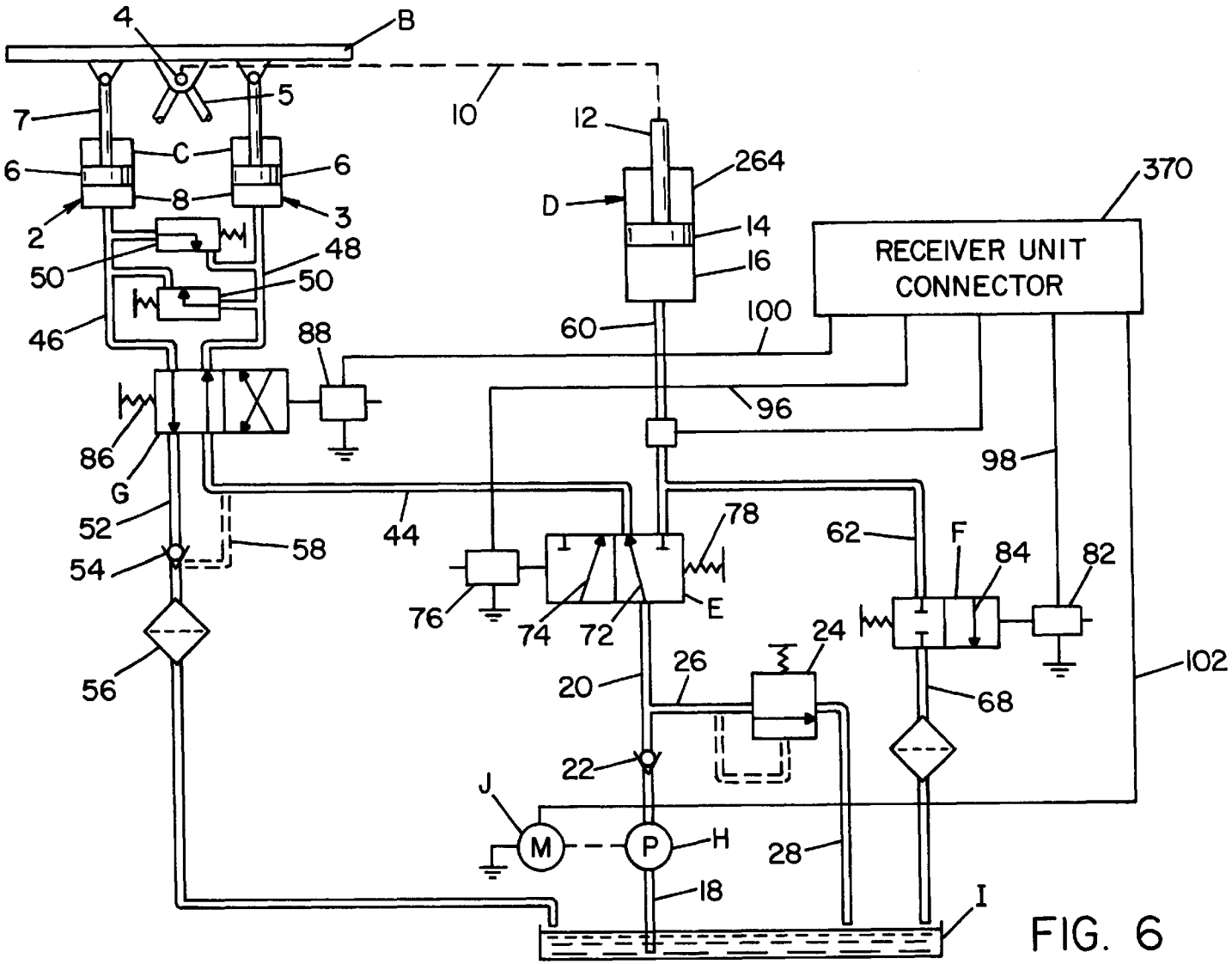
FIG. 6 is a schematic illustration of a vehicle mounted snowplow and the combined hydraulic and electrical system for controlling the position of the snowplow blade through a control system in accordance with the present invention.

Referring now to FIGS. 3, 5 and 6, operation of the system is described hereinafter in connection with a vehicle snowplow having a plow blade B, lift cylinder D, and reverse acting pivot cylinders C. The hydraulic and electrical systems of hydraulic control unit 270 are schematically illustrated in FIG. 6, and a more detailed description of the operation of the system is set forth in the Miceli and Ciula patents, which description is incorporated herein by reference. The components of hydraulic control unit 270 depicted in FIG. 6 have accordingly been assigned reference designators consistent with the description of the system found in the Miceli and Ciula patents. Thus, reference may be had to the disclosures of these patents for a detailed description of the operation of the system shown in FIG. 6, which accordingly need not be detailed herein except for the following description of the functionality of the switches 322 through 332 of switchpad 308.

With reference in particular to FIGS. 3 and 6, when power switch button 318 is engaged, power switch 320 closes, thereby activating power converter 304 which in turn energizes the various components of manual switch unit 286. When the operator presses one of the four directional switches 326 through 332 as shown in FIGS. 3 and 5, hydraulic control unit 270 is operated through solenoid operating unit 282 to selectively raise or lower or pivot blade B depending on which switch was pressed. For example, pressing switch 326 indicated in FIGS. 3 and 5 as an up switch, causes hydraulic fluid to flow to lift cylinder D in FIG. 6, thus raising plow blade B at a predetermined rate while switch 326 is maintained in the pressed position. Similarly, pressing switch 328 causes lowering of plow blade B at a predetermined rate while the switch is held in the pressed position. The user can thus press these switches for short intervals of time in order to achieve small adjustments in the vertical position of blade B. In similar fashion, pivoting of blade B about vertical axis 4 is achieved using left and right keys 330 and 332 to apply reverse acting actuation of pivot cylinder C, thus rotating blade B about axis 4 to a desired position. Actuation of float switch 322 causes plow blade B to be lowered to a position wherein blade B is supported by the ground, achieving the floating mode as described in the Ciula patent. Express switch 324 operates to change the effect of the operation of directional switches 326 through 332 from momentary operation to toggle-type operation, similar to that of the express down operation of driver side power window switches conrnon on many cars and trucks. Accordingly, once float switch 322 is engaged, a single momentary press of, for example, up switch 326 will cause plow blade B to be raised to its full up position. Likewise, a momentary press of right switch 332 will cause plow blade B to be rotated to its maximum pivoted position toward the light side of vehicle 250. A subsequent press of express switch 324 causes the operation of directional switches 326 through 332 to return to momentary-type operation. Alternative embodiments of manual switching unit 286 may include an LED or other indication on switchpad 308 near express switch 324 to indicate express mode is engaged.

It will further be appreciated that it is within the scope of the invention to provide a system having two-way communications between manual switching unit 286 and solenoid operating unit 282, employing a single-master polling type protocol wherein one of the units 282 or 286, (the slave), communicates only in response to requests by the other (the master), or a multiple-master system employing error detection schemes such as well known multiple-access collision detection or MACD protocols and the like. In addition, the present invention contemplates systems wherein a single switching unit such as unit 286 provides control signals and/or other data to multiple receiver units such as solenoid operating unit 282 which are connected at various points along the vehicle's DC power bus for control of a vehicle snowplow, sweeping apparatus, vacuums, lights, winches, salt spreaders, and other accessories or add-on equipment. In this regard, it will be appreciated that any of the communication protocols hereinabove mentioned, or combinations thereof, may be employed, and are within the scope of the present invention.

Figure 7:
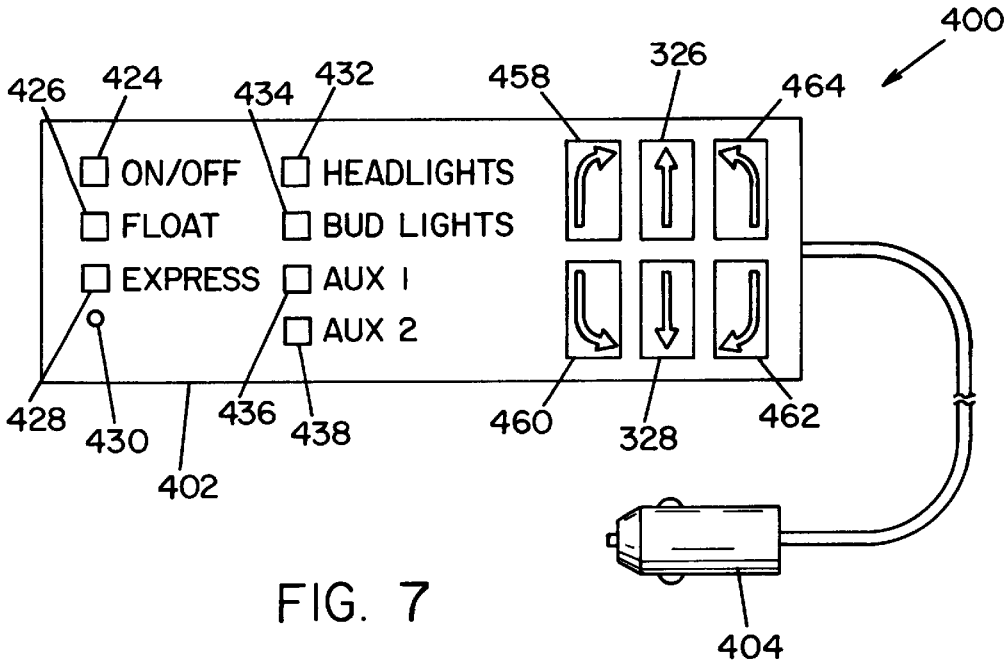
FIG. 7 is a front elevation view of a manual switching unit in accordance with the present invention.
Figure 8:
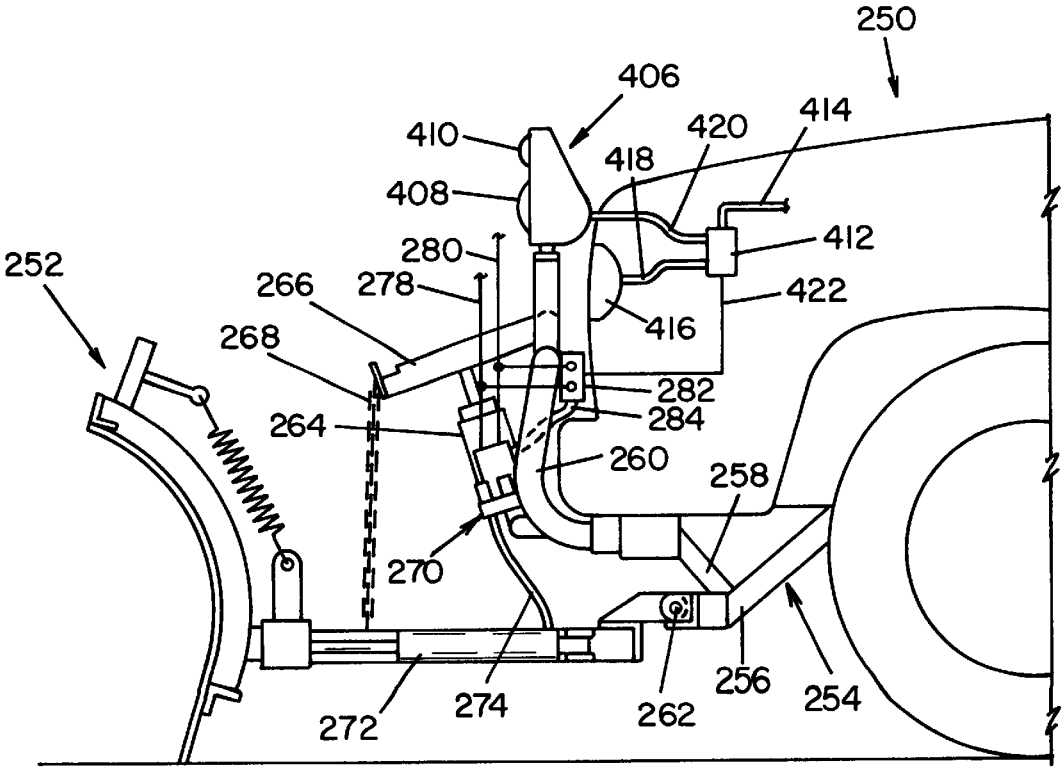
FIG. 8 is a side elevation view of a control system in accordance with the invention showing connection to auxiliary plow lights; and, FIG. 9 is a plan view of a dual snowplow system and a position control system therefor in accordance with the present invention.

Another of many possible embodiments of the present invention is illustrated in FIGS. 7 and 8, wherein manual switching unit 400 includes switchpad 402 and power connector 404 for connection to a vehicle DC power bus through a standard vehicle cigarette lighter power outlet as previously discussed. In this embodiment, switchpad 402 includes operator controls for a vehicle equipped with single-blade snowplow 252, or alternatively, a dual-blade snowplow system as illustrated in FIG. 9 and discussed further hereinafter, as well as operator controls for accessories associated with a snowplow including plow lights 406 having headlights 408 and bud lights 410 as shown in FIG.

8. Power for plow lights 406 is provided through cable 420 from switching unit 412 having cable connections to vehicle headlight power connector 414, vehicle mounted headlight 416 through cable 418, and plow light cable 420. In this fashion, switching unit 412 directs power to vehicle headlight 416 and plow lights 406 selectively in response to command signals received from solenoid operating unit 282 through cable 422. This allows the operator of the vehicle to selectively use the vehicle headlights 416 when the plow 252 is not installed on the vehicle, and to use plow lights 406 when plow 252 is installed on the vehicle. Referring again to FIG. 7, switchpad 402 includes power switch button 424, float switch 426, and express switch 428 having the same functions as corresponding switches 318, 322, and 324 as described above. Additionally, switchpad 402 is provided with an LED 430 for indication to the operator of express mode operation. Additional switches are provided in switchpad 402 for activation of headlights 408 and bud lights 410 using switches 432 and 434, respectively. In this regard, the vehicle's standard headlight switch operates as usual to enable or disable headlight operation completely. Headlight switch 432 on switchpad 402 further allows the vehicle operator to toggle between energizing the vehicle headlights 416 or alternatively plow light headlights 408 by signaling switching unit 412. In this sense, switch 432 operates as a toggle switch, as does bud light switch 434 which allows the operator to energize bud lights 410. Switches 436 and 438 are provided on switchpad 402 allowing toggle operation or alternatively, momentary operation of other accessories (not shown) installed on a vehicle.

Figure 9:
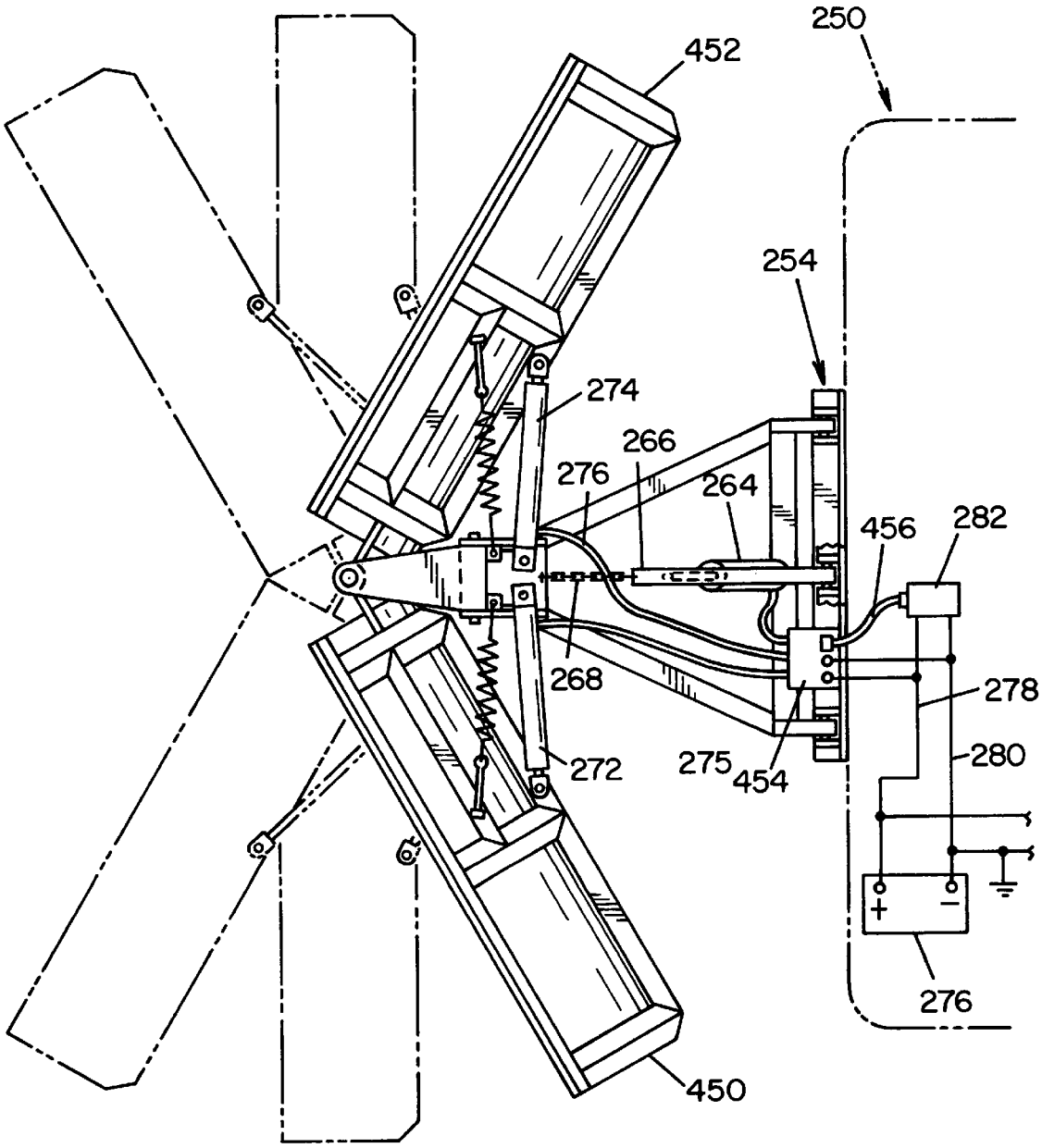

Referring now to FIG. 9, vehicle 250 is shown equipped with a dual snowplow system including left plow 450 and right plow 452, having a lift cylinder 264 and dual reverse acting pivot cylinders 272 and 274 with corresponding hydraulic fluid supply connections 275 and 276 to hydraulic control unit 454. Control unit 454 is connected though cable 456 to solenoid operating unit 282 for selective actuation of cylinders 264, 272 or 274 as previously described, thus allowing the operator of vehicle 250 to selectively position either or both of plows 450 and 452 by lifting or pivoting as needed. Switching unit 400 shown in FIG. 7 includes up and down switches 326 and 328 as described above to raise or lower plows 450 and 452. In addition, switchpad 402 further includes separate switches for left and right pivoting of plows 450 and/or 452 individually. These switches are shown in FIG. 7 as left plow right switch 458, left plow left switch 460, right plow right switch 462, and right plow left switch 464. These pairs of switches operate in similar fashion to left switch 330 and right switch 332 as previously described for individual pivoting of left plow 450 and right plow 452 between the plow positions shown in FIG. 9 in phantom.

While the above embodiments illustrate a control system for operating a snowplow and plow lights, it will be understood as within the scope of the invention to provide control systems for operating other vehicle accessories mounted onto or installed in a vehicle in a location remote from the vehicle operator. Thus, applications of the present invention include, without being limited to: plows, brooms, brushes, sweepers, lights, spreaders for salt or other materials, pumps, winches, and the like.

As many possible embodiments of the present invention may be made and as many possible changes may be made in the embodiment set forth herein, it is to be distinctly understood that the foregoing descriptive matter is to be interpreted merely as an illustration of specific embodiments of the invention, and not as a limitation thereof. It is applicant's intent to include all embodiments within the scope of the accompanying claims and all equivalents thereof.

Having thus described the invention, the following is claimed:

1. A system for controlling positions of a vehicle snow plow hydraulic lift control cylinder for raising a plow upon activation of a first solenoid by a first control signal, and at least one hydraulic pivot cylinder for pivoting said plow horizontally with respect to a vehicle upon activation of a second solenoid by a second control signal, said vehicle having an existing electrical network, said system comprising a manual switching unit including a first switch for creating a first digital command signal, a second switch for creating a second digital command signal, a coding circuit for creating a first communication signal upon receipt of said first digital command signal and a second communication signal upon receipt of said second digital command signal, a connector to electrically connect to a connector receptacle in said vehicle to allow said communication signals to be directed into at least a portion of said existing electrical network, said receptacle having a terminal connected to said existing electrical network, a solenoid operating unit configured to be fixed on said vehicle with an input, output and a receiver circuit, said input adapted to be connected to said existing electrical network, said output connected to each of said first and second solenoids, said receiver circuit creating said first command signal upon receipt of said first communication signal transmitted through at least a portion of said existing electrical network and said second command signal upon receipt of said second communication signal transmitted through at least a portion of said existing electrical network and directing said command signals to said outputs.

2. A system for controlling positions of a vehicle snow plow hydraulic lift control cylinder for raising a plow upon activation of a first solenoid by a first control signal and at least one hydraulic pivot cylinder for pivoting said plow horizontally with respect to a vehicle upon activation of a second solenoid by a second control signal, said vehicle having an electrical network, said system comprising a manual switching unit including a first switch for creating a first digital command signal, a second switch for creating a second digital command signal, a coding circuit for creating a first communication signal upon receipt of said first digital command signal and a second communication signal upon receipt of said second digital command signal, a connector to electrically connect to a connector receptacle in said vehicle to allow said communication signals to be directed into said electrical network, said receptacle having a terminal connected to said electrical network, a solenoid operating unit configured to be fixed on said vehicle with an input, output and a receiver circuit, said input adapted to be connected to said electrical network, said output connected to each of said first and second solenoids, said receiver circuit creating said first command signal upon receipt of said first communication signal transmitted through said electrical network and said second command signal upon receipt of said second communication signal transmitted through said electrical network and directing said command signals to said outputs, said coding circuit includes a modulator and said receiver circuit includes a demodulator.

3. The system as defined in claim 2, wherein said manual switching unit includes a switchpad having up, down, left, and right control switches, said coding circuit further includes a multiplexer and an encoder, and said receiver circuit further includes a decoder.

4. The system as defined in claim 3, wherein said modulator is a frequency modulator.

5. The system as defined in claim 3, wherein said modulator is a frequency shift keying modulator.

6. The system as defined in claim 5, wherein said input includes a band pass filter.

7. The system as defined in claim 4, wherein said input includes a band pass filter.

8. The system as defined in claim 7, wherein said receiver circuit includes a pilot loss detector.

9. The system as defined in claim 7, wherein said receiver circuit includes a microprocessor.

10. The system as defined in claim 3, wherein said coding circuit derives power from said vehicle electrical network.

11. The system as defined in claim 3, wherein said manual switching unit further includes light control switches and said solenoid operating unit further includes light power outputs.

12. The system as defined in claim 11, wherein said light control switches include headlight, auxiliary light and bud light control switches.

13. The system as defined in claim 3, wherein said manual switching unit further includes a float control switch.

14. The system as defined in claim 3, wherein said manual switching unit further includes an express control switch which operates to shift operation of all said switches between momentary operation and toggle operation.

15. The system as defined in claim 3, wherein said manual switching unit further includes two sets of right and left control switches for operating a dual blade plow system.

16. The system as defined in claim 1, wherein said outputs include power semiconductor devices.

17. The system as defined in claim 3, wherein said coding circuit further includes a microprocessor.

18. The system as defined in claim 1, wherein said connector receptacle is a standard vehicle cigarette lighter outlet.

19. An apparatus for controlling a position of a vehicle snow plow having a hydraulic lift control cylinder for raising and lowering said plow, at least one hydraulic pivot control cylinder for pivoting said plow with respect to a vehicle, and a hydraulic control unit with a hydraulic fluid reservoir, fluid lines, valves, and associated solenoids for operating said lift and pivot control cylinders in response to an electrical control signal, said apparatus comprising a first unit having a first housing, a first connector attached to said first housing for electrical connection to an existing vehicle DC power bus through a DC power outlet in said vehicle, a switching circuit having a plurality of switches mounted on said first housing, each of said switches generating a signal indicative of its electrical state and being electrically connected to an encoder circuit mounted in said first housing and providing a digital signal representative of said states of said switches, and a transmitter circuit mounted in said first housing and applying said digital signal onto at least portion of said existing DC bus, and a second unit having a second housing, a second connector attached to said second housing for electrical connection to said existing DC bus, a receiver circuit mounted in said second housing and receiving said digital signal transmitted through at least a portion of said existing DC bus, a decoder circuit mounted in said second housing in electrical connection with said receiver circuit and providing an electrical control signal upon receipt of said digital signal, and a third connector for electrical connection of said electrical control signal to said hydraulic control unit, whereby said lift and pivot control cylinders are operated according to said states of said switches thereby controlling said snow plow position.

20. An apparatus for controlling position of a vehicle snow plow having a hydraulic lift control cylinder for raising and lowering said plow, at least one hydraulic pivot control cylinder for pivoting said plow with respect to a vehicle, and a hydraulic control unit with a hydraulic fluid reservoir, fluid lines, valves, and associated solenoids for operating said lift and pivot control cylinders in response to an electrical control signal, said apparatus comprising a first unit having, a first housing, a first connector attached to said first housing for electrical connection to a vehicle DC power bus through a DC power outlet in said vehicle, a switching circuit having a plurality of switches mounted on said first housing, each of said switches generating a signal indicative of its electrical state and being electrically connected to an encoder circuit mounted in said first housing and providing a digital signal representative of said states of said switches, and a transmitter circuit mounted in said first housing and applying said digital signal onto said DC bus, and a second unit having a second housing, a second connector attached to said second housing for electrical connection to said DC bus, a receiver circuit mounted in said second housing and receiving said digital signal from said DC bus, a decoder circuit mounted in said second housing in electrical connection with said receiver circuit and providing an electrical control signal upon receipt of said digital signal, and a third connector for electrical connection of said electrical control signal to said hydraulic control unit, whereby said lift and pivot control cylinders are operated according to said states of said switches thereby controlling said snow plow position, said encoder circuit includes a multiplexer, a digital encoder and said decoder circuit includes a digital decoder.

21. The apparatus as defined in claim 20, wherein said encoder circuit further includes a modulator and said decoder circuit further includes a demodulator.

22. The apparatus as defined in claim 21, wherein said modulator is of a frequency modulation type.

23. The apparatus as defined in claim 21, wherein said receiver circuit includes a band pass filter.

24. The apparatus as defined in claim 22, wherein said modulator is of a frequency shift keying type.

25. The apparatus as defined in claim 20, wherein said switching circuit includes a switchpad having up, down, left, and right control switches.

26. The apparatus as defined in claim 25, wherein said switchpad circuit further includes light switches and said third connector includes electrical light power connections.

27. The apparatus as defined in claim 26, wherein said light switches include headlight, bud light, and auxiliary light switches.

28. The apparatus as defined in claim 25, wherein said switchpad further includes a float control switch.

29. The apparatus as defined in claim 25, wherein said switchpad further includes an express control switch which shifts operation of all said switches between momentary operation and toggle operation.

30. The apparatus as defined in claim 19, wherein said first unit derives power from said DC power bus.

31. The apparatus as defined in claim 20, wherein said decoder circuit further includes a microprocessor.

32. The apparatus as defined in claim 21, wherein said decoder circuit further includes a pilot loss detector.

33. The apparatus as defined in claim 19, wherein said decoder circuit includes power semiconductor devices.

34. An apparatus for controlling a position of a vehicle snow plow having a hydraulic lift control cylinder for raising and lowering said plow, at least one hydraulic pivot control cylinder for pivoting said plow with respect to a vehicle, and a hydraulic control unit with a hydraulic fluid reservoir, fluid lines, valves, and associated solenoids for operating said lift and pivot control cylinders by a solenoid operating unit upon receipt of an electrical control signal directed through at least a portion of an existing DC power bus in said vehicle, said apparatus comprising a unit having a housing, a connector attached to said housing for electrical connection to said DC power bus through a DC power outlet in said vehicle, a plurality of switches mounted on said housing, each said switch defining an electrical state and electrically connected to an encoder circuit mounted in said housing and providing a digital signal representative of said states of said switches, and a transmitter circuit mounted in said housing and directing said digital signal into at least a portion of said DC bus.

35. A method of controlling the positions of a vehicle snow plow hydraulic lift control cylinder for raising a plow upon activation of a first solenoid by a first control signal, and at least one hydraulic pivot cylinder for pivoting said plow with respect to said vehicle upon activation of a second solenoid by a second control signal, said vehicle having an existing electrical network, said method comprising providing a manual switching unit including at least one switch for creating a first digital command signal, providing a second switch for creating a second digital command signal, creating a first communication signal upon receipt of said first digital command signal and a second communication signal upon receipt of said second digital command signal, applying said communication signals into at least a portion said network, providing a solenoid operating unit fixed on said vehicle with an input connected to said network, outputs connected to each of said solenoids, and creating said first command signal upon receipt of said first communication signal and said second command signal upon receipt of said second communication signal and applying said command signals to said outputs.

36. A method of controlling a vehicle mounted accessory comprising providing a manual switching unit having at least one switch operable by an operator in a passenger compartment of said vehicle, providing an accessory operating unit adapted to operate said vehicle mounted accessory in response to an electrical command signal, connecting said switching unit and said operating unit to an electrical network existing in said vehicle, and transmitting said electrical command signal from said switching unit to said operating unit through at least a portion of said existing electrical network wherein said electrical command signal is representative of an electrical state defined by a position of said at least one switch whereby said accessory is controlled by a manipulation of said at least one switch by said operator.

37. The method of claim 36, wherein said accessory includes a plow.

38. A system for controlling an operation of a vehicle mounted accessory installed in a vehicle having an existing electrical network, said system comprising a switching unit having at least one switch operable by an operator in a passenger compartment of said vehicle and electrically connected to said existing electrical network, and an accessory operating unit electrically connected to said electrical network to operate said accessory in response to an electrical command signal at least partially directed through said existing electrical network, said switching unit directing said electrical command signal into at least a portion of said electrical network, and said electrical command signal being representative of a state of said at least one switch.

39. The system of claim 38, wherein said accessory is a snowplow having hydraulic lift and pivot control cylinders and a hydraulic control unit with a hydraulic fluid reservoir, fluid lines, valves, and associated solenoids for operating said lift and pivot control cylinders, and said operating unit is adapted to operate said control cylinders according to said electrical command signal.

40. The system of claim 38, wherein said electrical network is adapted to supply electrical power to a plurality of components in said vehicle.

* * * * *